United States Patent [19]

Peritt

[11] 4,168,049

[45] Sep. 18, 1979

[54] RIGID MOUNT FOR AN INTERNALLY PRESSURIZED TUBE

[75] Inventor: Harvey L. Peritt, Beltsville, Md.

[73] Assignee: The United States of America as represented by the Secretary of the Navy, Washington, D.C.

[21] Appl. No.: 891,658

[22] Filed: Mar. 30, 1978

[51] Int. Cl.[2] ..... F41A 11/24

[52] U.S. Cl. ..... 267/124; 89/37 R; 248/603

[58] Field of Search ..... 248/54 R, 49, 74 R; 138/28, 113, 114; 89/14 R, 14 A, 37 R; 42/76 R; 285/133 R, 138, 187

[56] References Cited

U.S. PATENT DOCUMENTS

| | | | |
|---|---|---|---|
| 390,240 | 10/1888 | Legat | 285/133 R |
| 1,290,853 | 1/1919 | Sturgeon | 89/14 A |
| 1,824,717 | 9/1931 | Harty et al. | 138/113 X |
| 2,121,319 | 6/1938 | Fluor et al. | 138/114 X |
| 3,090,150 | 5/1963 | Stoner | 89/14 A |
| 3,606,218 | 9/1971 | Enlund et al. | 248/54 R X |
| 3,768,765 | 10/1973 | Breckenridge | 248/DIG. 1 |

FOREIGN PATENT DOCUMENTS

| | | | |
|---|---|---|---|
| 96763 | 1/1960 | Denmark | 138/113 |
| 352616 | 4/1922 | Fed. Rep. of Germany | 138/113 |
| 234835 | 10/1925 | United Kingdom | 89/14 A |

*Primary Examiner*—J. Franklin Foss

*Attorney, Agent, or Firm*—R. S. Sciascia; Sol Sheinbein; William C. Anderson

[57] ABSTRACT

An internally pressurizable expansible body is supported by an improved rigid mount which minimizes stresses induced in the body due to constraining radial expansion of the body. The mount comprises a plurality of resilient members juxtaposed between the body and a fixed annulus which is capable of carrying axial, transverse and torsional loads imposed upon the body.

17 Claims, 7 Drawing Figures

RIGID MOUNT FOR AN INTERNALLY PRESSURIZED TUBE

BACKGROUND OF THE INVENTION

The present invention relates generally to rigid mounts for expansible bodies. More particularly, the invention relates to a rigid mount for an internally pressurizable plastic tube which does not restrict radial expansion of the tube due to internal pressure.

The mounting of glass reinforced plastic (GRP) gun tubes, recoilless rifles or rocket launchers to a stable launch platform has always been a problem because of the low stiffness, high radial expansion and weak interlaminar shear strength of this material. The mounts used for these devices must however be rigid in order to obtain a desired degree of accuracy of fire. Prior art metal mounting rings of the type generally shown in U.S. Pat. No. 2,969,214, issued Jan. 24, 1961 to Torresen and U.S. Pat. No. 2,684,221, issued July 20, 1954 to Wollam have been bonded or mechanically attached to the outside diameter of the GRP tube thus forming a convenient attachment point. In use, the metal ring or mount could be welded to or threaded to a tripod, aircraft munitions rack or other appropriate structural member in order to provide a stable launch platform. Welding directly to the plastic tube is not a viable or convenient mode of attachment because of the characteristics of the material. Also, bolting or threading the mount directly to the GRP tube is not advisable because of the high stress concentrations invariably induced in the GRP tube. Most importantly the major disadvantage of a metal mounting ring is that it constrains or restricts the radial expansion of these pressurizable bodies or expansible tubes when internal pressure is present within the tube, e.g. at launch. This restriction results in relatively high bending stresses or discontinuity stresses in the GRP tube where the edge of the metal ring contacts the tube.

In order to partially overcome the severe restrictions of a metal ring used by the prior art, an attachment method which has been frequently used consists in bonding a plurality of metal flanges about certain portions of the periphery of the tube and constraining the extremities of the flanges by GRP strapping bands which are also bonded to the tube. The flanges may have mounting ears which can be welded or mechanically attached to a launch platform. However, this method has also shown to be unsatisfactory because radial restriction occurs at the ear locations on the flange thus inducing bending stresses in the tube. Furthermore, a transverse load imposed on the tube will cause concentrated bending stresses in the tube proximate the ear locations.

Alternatives to using a metal ring or flanges with ear attachments, both of which have been shown to induce discontinuity stresses in pressurizable plastic tubes include the following: (1) increasing the thickness of the tube locally with GRP materials and mechanically attaching a mounting surface to this increased diameter section and (2) attaching the mounting surface directly to the tube wall. The former method unfortunately and unduly restricts radial expansion, albeit not as much as for a metallic ring. The latter method is also undesirable in that it may require attachment holes or slots formed in the tube wall which severly weaken relatively brittle materials like GRP.

SUMMARY OF THE INVENTION

It is therefore an object of the invention to provide a mew and improved rigid mount for expansible bodies.

Another object of the instant invention is the provision of a new and improved rigid mount for pressurizable bodies which are made of a material which has low stiffness, high radial expansion and weak interlaminar shear strength.

A further object of the present invention is to provide a new and improved rigid mount for pressurizable GRP tubes which minimizes stresses induced in the tubes due to restriction of the radial expansion of the tubes.

Still another object of the invention is the provision of a new and improved rigid mount for pressurizable tubes which allows radial expansion of the tubes yet may still provide sufficient support for the tubes under axial, transverse and torsional loading.

Briefly, in accordance with one embodiment of the invention, these and other objects are attained in a rigid mount comprising an outer ring which is resiliently and concentrically disposed about an internally pressurizable plastic body. A plurality of wedges are fixed about and on the body and provide a support for pistons which reciprocate in chambers formed in the ring. The reciprocable pistons are resiliently supported within the chambers by compression springs so that when the body expands under internal pressure the wedges and pistons are forced outward and compress the springs. When the pressure in the body is released, the springs return the wedges and pistons to their original position. The only forces restraining the radial expansion of the body, therefore, are due to the compression of the springs. The strength of the springs can be made sufficiently weak in order to induce negligible stresses in the body. Provisions can be made in the manner of attachment of the wedges to the body to insure that axial, transverse and torsional loads are readily transmitted to the outer ring without inducing untoward stresses in the body.

BRIEF DESCRIPTION OF THE DRAWINGS

A more complete appreciation of the invention and many of the attendant advantages thereof will be readily appreciated as the same becomes better understood by reference to the following detailed description when considered in connection with the accompanying drawings, wherein.

DESCRIPTION OF THE PREFERRED EMBODIMENT

Figure 1:
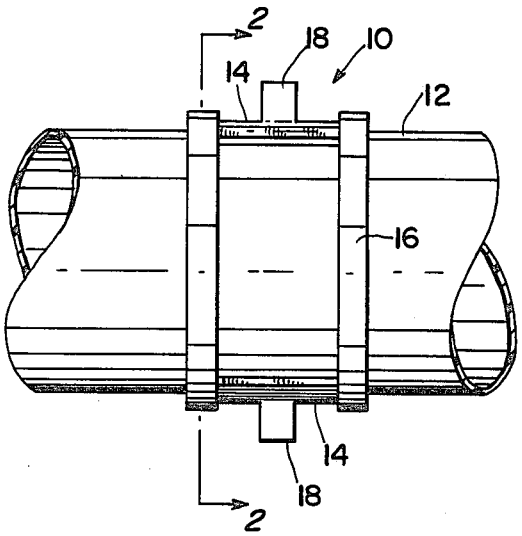
PRIOR ART FIG. 1
FIG. 1 illustrates a side view of one embodiment of the prior art.

Glass reinforced plastic (GRP) is considered an ideal candidate as a material for aircraft gun tubes, recoilless rifles or rocket launchers because it is lightweight, nonmagnetic, relatively inexpensive and in certain configurations as strong as some of the more commonly selected steels. However, the mounting of these devices on launching platforms has always been a problem because of the low stiffness, high radial expansion and weak interlaminar shear strength of GRP. A prior art mount 10, shown in FIG. 1, has been used to support a GRP tube and is shown as having a plurality of metal flanges 14, having attachment ears 18, bonded to a GRP tube 12. Glass reinforced plastic strapping bands 16 are bonded to tube 12 and overlap the ends of metal flanges 14.

In use, the ears 18 of flanges 14 are welded or mechanically attached to components of a tripod, aircraft rack, pod, or other element to which the tube is to be mounted. When tube 12 is instantaneously pressurized during use, e.g., launch conditions, radial restriction occurs at ear locations 18 and bending stresses are thereby induced in the tube. Furthermore, a transverse load on the tube will cause concentrated bending stresses at the ears. Alternatives to the design of FIG. 1 might be the use of single or multiple ear attachments instead of the two ears shown in FIG. 1. As was explained, supra, the use of this mount has proven to be unsatisfactory.

Figure 3:
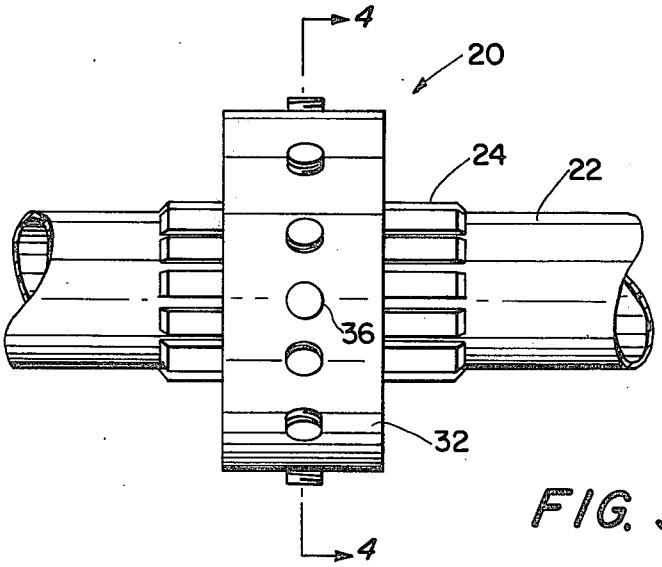
FIG. 3 is a side view of a glass reinforced tube supported by the rigid mount of the present invention.
Figure 4:
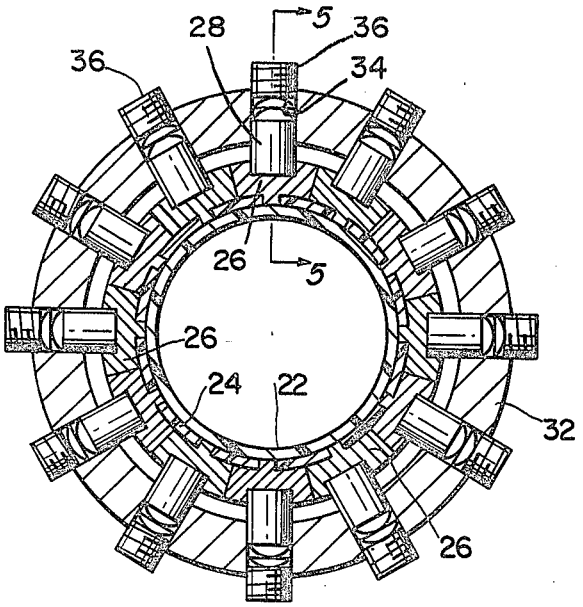
FIG. 4 is a sectional view of the rigid mount of the present invention taken along lines 4—4 in FIG. 3.
Figure 5:
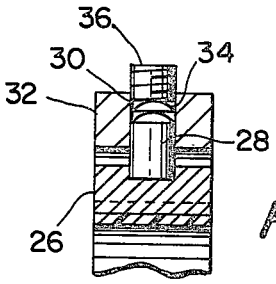
FIG. 5 is a partial sectional view taken along lines 5—5 in FIG. 4.

Referring now to FIGS. 3-5, the new and improved mount 20 of the present invention is shown as being attached to an expansible body of glass reinforced plastic or tube 22. A plurality of splines or key ways 24 are bonded or integrally formed about the periphery of tube 22 and provide a foundation for a series of trapezoidal wedges 26 having keys which fit within key ways 24. An annulus or ring 32 may be concentrically disposed about tube 22 and is provided with a plurality of open-ended chambers 30 for an equal number of reciprocable pistons 28. The pistons 28 lie along radii of the tube 22 and are biased radially inwards by springs 34 which are placed within chambers 30. These springs 34 may be belleville or coil springs and are held in place on top of pistons 28 by means of threaded plugs 36 which close off the open ends of chambers 30.

In operation, when the tube expands under internal pressure which may be due to the launching of a projectile or rocket, wedges 26 and pistons 28 are forced radially outward and compress springs 34. When the pressure in the tube is released springs 34 return pistons 28 to their original position. The only forces restraining the radial expansion of tube 22 are due to the compression of springs 34. The strength of the springs can be made sufficiently weak so that only negligible stresses are induced in the tube due to this constraint while still providing a mount which can ensure accuracy of fire when used with a stable launch platform. The local increase in the thickness of tube 22 which is required for key ways 24 does not significantly increase the restriction on the radial expansion of the tube.

Figure 2:
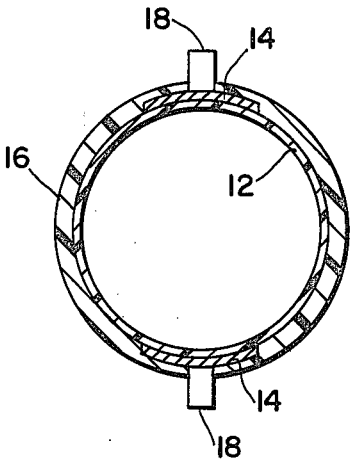
PRIOR ART FIG. 2
FIG. 2 is an elevational view taken along line 2—2 in FIG. 1.

A torque load applied to tube 22 would be transmitted to the wedges through the key ways and then to the outer ring via the pistons. A load transverse to the tube axis would be resisted by the wedges, pistons and springs thereby being transmitted to the outer ring 32 via these components. It is important to note that a transverse load on the tube does not place concentrated forces on the tube because the springs 34 substantially reduce this loading on the tube. This is in contrast to the ear attachment method of FIGS. 1 and 2 where severe local forces are placed on the tube. Torque and/or transverse loads in the outer ring 32 are transmitted to a mounting tripod, pod, aircraft rack or other stable launching platform by welding or mechanically attaching directly to the outer ring.

Figure 6:
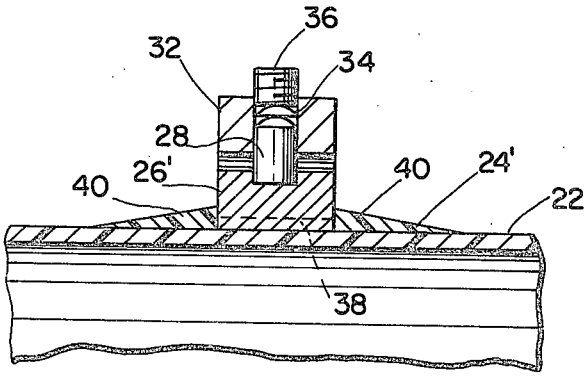
FIGS. 6 and 7 are partial side elevational views of alternative embodiments of an axial restraint for the rigid mount of the present invention.
Figure 7:
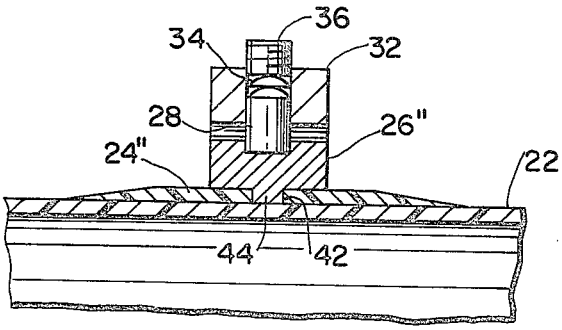

Alternatives to the wedge-key way interface are shown in FIGS. 6 and 7 in which the mount is capable of resisting axial, torque (imposed by possible rifling of the tube) and transverse loads and axial and transverse loads alone, respectively. In FIG. 6, a GRP modified keyway or axial restraint 24', affixed on the tube, is shown as supporting a modified wedge 26' against axial, torque and transverse loads that may be imposed on the tube during use. As can be seen, the axial restraint 24' is tapered to reduce stresses due to any increase in the restriction of the radial expansion of tube 22. Wedge 26' is formed with a key way groove formed in its lower portion which cooperates with a key 38 formed in the restraint 24'. As is clear, the tapered portions or ramps 40 abut wedge 26' thereby providing a constraint on the axial movement of the tube 22. Torsional and transverse loadings are transmitted as before.

Referring now to FIG. 7, a GRP axial restraint 24" is shown as being bonded to the tube wall of tube 22 and having a circumferential ring groove or key way 42 formed within. Each wedge 26" is provided with a key or tongue 44 which fits within the ring groove 42. This mount thus is capable of resisting axial and transverse loads that may be imposed on the tube. It is noted that the GRP axial restraint 24" is also substantially tapered to reduce stresses which might be induced in tube 22 due to restriction on the radial expansion of the tube caused by the increase in the local tube diameter.

As described above, the main feature of the present invention is that a mounted or supported expansible body, which may be pressurized, is free to expand radially under the effects of the internal pressure without inducing stresses caused by a constraint on such radial expansion. No discontinuity stresses are induced in a tube whose mount does not restrict it from expanding radially but which nevertheless ensures that the tube may be used where accuracy of fire is desired in launching. It has also been shown that transverse and torque loads applied to the tube can be transmitted to the outer ring of the mount. Moreover, the mount transmits these forces evenly about the tube circumference precluding the inducement of high concentrated stresses. This latter feature is in contrast to the mounting method shown in FIG. 1 in which concentrated stresses are placed on the tube at the ear connections.

Although the drawings disclose a preferred embodiment, it should be understood that modifications may be made to the invention without departing from the spirit thereof. For instance, although the preferred embodiment is made of glass reinforced plastic, the invention is applicable to expansible tubes or bodies made from materials that cannot withstand stresses induced in the material due to a constraint on its radial expansion. Additionally, rubbery or foam cushion may replace the belleville or coil springs. Further, the wedges, pistons, ring and plugs can be made from any metallic or nonmetallic material. Also, the wedges could have parallel sides instead of the trapezoidal shape shown in FIG. 4. Finally, when the tube is not expected to have torque loading there is no necessity for the wedges and tube to have splines or keyways. In this last case, the bottom surface of the wedges would have a concave portion that coincides with the convexity of the tube. Other structural modifications may be made by one skilled in the art without departing from the spirit of the invention as defined by the claims which follow.

What is claimed and desired to be secured by Letters Patent of the United States is:

1. An improved mount for an expansible body, said mount minimizing stresses induced in said body due to restriction of the radial expansion of said body, comprising:

a fixed annulus disposed contiguous to said body;

resilient means juxtaposed and fixed between said body and said annulus for resiliently supporting said body relative to said annulus; and a plurality of wedges interdisposed between said resilient means and said body;

said body provided with a plurality of keyways disposed on the outer periphery of said body;

whereby said body is free to expand radially.

2. The mount of claim 1, wherein said wedges are trapezoidal in shape and fixedly keyed to said body.

3. The mount of claim 2, wherein said resilient means comprises a plurality of pistons reciprocable within said annulus.

4. The mount of claim 3 wherein one of said pistons is mounted upon each of said wedges.

5. The mount of claim 3, wherein said annulus is provided with a plurality of chambers.

6. The mount of claim 5, wherein one of said pistons reciprocates within each of said chambers.

7. The mount of claim 6, wherein each of said chambers is open at the end proximate said body, the other end of each of said chambers being closable by a threaded plug.

8. The mount of claim 7, wherein the longitudinal axis of each said pistons lie along a radius from said body.

9. The mount of claim 8, wherein said resilient means further comprises a plurality of compressible springs, one disposed in each of said chambers between said plug and each of said pistons;

whereby when said body expands, said wedges and said pistons are forced radially outward and compress said springs; when said body contracts, said springs return said wedges to their original position thereby minimizing stresses induced in said body due to restriction of the radial expansion of said body.

10. The mount of claim 1, wherein each of said wedges are provided with a key which cooperates with one of said key ways.

11. The mount of claim 1, wherein one of said key ways abuts one of said wedges and is tapered along the longitudinal axis of said body in order to reduce stresses in said body due to radial restriction of said body.

12. The mount of claim 11, wherein each of said wedges is provided with a groove which cooperates with each of said keyways in order to restrict axial movement of said body and transmit axial, torque and transverse loading imposed on said body to said mount.

13. An improved mount for an expansible body, said mount minimizing stresses induced in said body due to restriction of the radial expansion of said body, comprising:

a fixed annulus disposed contiguous to said body;

resilient means juxtaposed and fixed between said body and said annulus for resiliently supporting said body relative to said annulus; and a plurality of wedges interdisposed between said resilient means and said body;

said body provided with an axial restraint affixed thereon, said axial restraint having a circumferential groove;

whereby said body is free to expand radially.

14. The mount of claim 13, wherein each of said wedges has a tongue which cooperates with said circumferential groove.

15. The mount of claim 14, wherein said axial restraint is substantially tapered towards said wedges in order to reduce stresses induced in said body due to the increased thickness of said body when said axial restraint is affixed thereon.

16. The mount of claim 13, wherein said body is made of a material having low stiffness, high radial expansion and weak interlaminar strength.

17. The mount of claim 15, wherein the material is glass reinforced plastic and said body is a tube.

* * * * *